US011807827B2

(12) United States Patent
Garelick

(10) Patent No.: US 11,807,827 B2
(45) Date of Patent: Nov. 7, 2023

(54) LUBRICATING COMPOSITIONS FOR REDUCED HIGH TEMPERATURE DEPOSITS

(71) Applicant: Afton Chemical Corporation, Richmond, VA (US)

(72) Inventor: Kenneth Garelick, Mechanicsville, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 17/578,070

(22) Filed: Jan. 18, 2022

(65) Prior Publication Data

US 2023/0227748 A1 Jul. 20, 2023

(51) Int. Cl.

| | |
|---|---|
| ***C10M 137/10*** | (2006.01) |
| ***C10M 135/10*** | (2006.01) |
| ***C10M 129/10*** | (2006.01) |
| ***C10M 169/04*** | (2006.01) |
| *C10N 30/00* | (2006.01) |
| *C10N 10/02* | (2006.01) |
| *C10N 10/04* | (2006.01) |

(Continued)

(52) U.S. Cl.

CPC ..... *C10M 137/10* (2013.01); *C10M 129/10* (2013.01); *C10M 135/10* (2013.01); *C10M 169/04* (2013.01); *C10M 2207/023* (2013.01); *C10M 2219/046* (2013.01); *C10M 2223/045* (2013.01); *C10N 2010/02* (2013.01); *C10N 2010/04* (2013.01); *C10N 2020/02* (2013.01); *C10N 2030/04* (2013.01); *C10N 2030/06* (2013.01); *C10N 2030/42* (2020.05); *C10N 2030/45* (2020.05); *C10N 2030/52* (2020.05); *C10N 2030/54* (2020.05); *C10N 2040/25* (2013.01)

(58) Field of Classification Search

CPC ..... C10M 137/10; C10M 129/10; C10M 135/10; C10M 169/04; C10M 2207/023; C10M 2219/046; C10M 2223/045; C10N 2010/02; C10N 2010/04; C10N 2020/02; C10N 2030/04; C10N 2030/06; C10N 2030/42; C10N 2030/45; C10N 2030/52; C10N 2030/54; C10N 2040/25

See application file for complete search history.

(56) References Cited

U.S. PATENT DOCUMENTS 5,362,419 A 11/1994 Zinke et al.
5,578,236 A 11/1996 Srinivasan et al.
(Continued)

FOREIGN PATENT DOCUMENTS

CN 102575186 A 7/2012
EP 0894845 A1 2/1999
(Continued)

OTHER PUBLICATIONS

Huanmou et al., "Lubricity of Carboxyl Acid Derivatives of O,O-dialkyl-phosphorodithioate," Journal of Hunan University, vol. 23, No. 3, (1996), pp. 65-70.

*Primary Examiner* — Ellen M McAvoy
(74) *Attorney, Agent, or Firm* — Honigman LLP

(57) ABSTRACT

This disclosure describes blends of detergent and antiwear lubricating additives and lubricants including such additive blends effective to reduce high-temperature deposits, and in particular, high-temperature deposits in low ash compositions.

24 Claims, 2 Drawing Sheets

(51) Int. Cl.

| | |
|---|---|
| *C10N 20/02* | (2006.01) |
| *C10N 30/04* | (2006.01) |
| *C10N 30/06* | (2006.01) |
| *C10N 40/25* | (2006.01) |

(56) References Cited

U.S. PATENT DOCUMENTS

| | | | | |
|---|---|---|---|---|
| 5,922,657 | A | 7/1999 | Camenzind et al. | |
| 6,451,745 | B1 | 9/2002 | Ward | |
| 2006/0063685 | A1 | 3/2006 | Purmer et al. | |
| 2006/0223724 | A1* | 10/2006 | Gatto | C10M 141/06 508/545 |
| 2006/0264340 | A1 | 11/2006 | Iyer et al. | |
| 2009/0233822 | A1 | 9/2009 | Iyer | |
| 2009/0233823 | A1 | 9/2009 | Fahl et al. | |
| 2010/0317552 | A1* | 12/2010 | Griffin | C10M 141/12 508/279 |
| 2011/0237474 | A1* | 9/2011 | Mazzamaro | C10M 141/08 508/364 |
| 2011/0287990 | A1* | 11/2011 | Farng | C10M 163/00 508/186 |
| 2013/0008756 | A1 | 1/2013 | Noles, Jr. et al. | |
| 2014/0038866 | A1 | 2/2014 | Barton | |
| 2014/0097059 | A1 | 4/2014 | Tang et al. | |
| 2015/0175923 | A1* | 6/2015 | Gaal | C10M 129/76 508/517 |
| 2015/0175925 | A1* | 6/2015 | Dance | C10M 141/08 508/198 |
| 2017/0211007 | A1* | 7/2017 | Deckman | C10M 129/68 |
| 2018/0066203 | A1 | 3/2018 | Dance et al. | |
| 2018/0119048 | A1* | 5/2018 | Deckman | C10M 145/38 |
| 2019/0127655 | A1* | 5/2019 | Dance | C10M 129/54 |
| 2019/0345407 | A1* | 11/2019 | Deckman | C10M 169/041 |
| 2020/0165537 | A1* | 5/2020 | Deckman | C10M 169/04 |
| 2020/0181525 | A1* | 6/2020 | Deckman | C10M 119/12 |
| 2022/0010234 | A1* | 1/2022 | Delbridge | C10M 135/10 |

FOREIGN PATENT DOCUMENTS

| | | | |
|---|---|---|---|
| EP | 1233054 | A1 | 8/2002 |
| EP | 1262538 | A2 | 12/2002 |
| EP | 0856042 | B1 | 1/2003 |
| EP | 1529831 | A2 | 5/2005 |
| WO | 2011143418 | A1 | 11/2011 |

* cited by examiner

LUBRICATING COMPOSITIONS FOR REDUCED HIGH TEMPERATURE DEPOSITS

TECHNICAL FIELD

This disclosure relates to additive systems and lubricating compositions including the additive systems configured for reduced high temperature deposits and, in particular, lubricating compositions capable of achieving reduced high temperature deposits in low ash formulations.

BACKGROUND

Automotive manufacturers continue to the push for improved efficiency and fuel economy, and as such, demands on engines, lubricants, and their components continue to increase. Today's passenger car engines are often smaller, lighter and more efficient with technologies designed to improve fuel economy, performance, and power. These requirements also mean engine oil performance must evolve to meet the higher demands of such modern engines and their corresponding performance criteria tied to their unique use and applications. With such exacting demands for engine oils, lubricant manufacturers often tailor lubricants and their additives to meet certain performance requirements for each unique application.

For example, the Thermo-Oxidation Engine Oil Simulation test (TEOST-33C) was developed as a lubricant test for the evaluation of turbocharger-coking properties. In this test, a mass of deposits occurring on a test piece, the depositor rod, is measured as a test lubricant passes the depositor rod and heated to about 200° C. to about 500° C. The test is designed, in part, to predict the high temperature deposit forming tendencies of an engine oil subject to the added oxidizing stress of a turbocharger and has commonly been a component of API and ILSAC standards over the years.

Lubricant specifications often include compositional constraints in terms of the permitted levels of sulfated ash, phosphorus, and sulfur (so-called SAPS limits) and maintaining such constraints while still meeting the heightened demands of the newest lubricant standards tends to be challenging. For example, due to environmental considerations, exhaust after-treatment devices are often fitted to vehicles in order to reduce particulate matter and other various emissions therefrom. However, the sulfated ash, sulfur and/or phosphorus concentrations of lubricating oil compositions conventionally used in internal combustion engines may have adverse effects on such after-treatment devices and lubricants are commonly formulated to minimize the sulfated ash, phosphorus, and sulfur therein.

Sulfated ash is a measurement that indicates the total weight percent of ash in a lubricating oil composition. The sulfated ash measurement for a lubricating oil composition is related to the total metal content therein and may be conveniently measured according to ASTM D-874 and/or other common evaluation methods known in the art and as described herein. In many circumstances, however, varying one component within a lubricant composition to improve certain performance characteristics tends to negatively impact one or more other performance characteristics. For instance, the major sources of ash in a lubricating oil composition are generally metal detergent additives and/or anti-wear additives. However, it has been discovered that reducing the amount of detergent or antiwear components to decrease sulfated ash content tends to negatively impact other performance characteristics, and in particular, reduced detergent and/or antiwear tends to increase deposits in the high temperature performance testing of TEOST-33C, for example.

SUMMARY

In one approach or embodiment, a lubricating composition for reducing high temperature deposits is provided. In one aspect, the lubricating composition includes one or more base oil(s) of lubricating viscosity; a detergent system providing an amount of metal to the lubricating composition, where the metal is at least one of sodium, calcium, magnesium, or combinations thereof; an antiwear system including one or more metal dialkyl dithiophosphates derived from one of primary alcohols, secondary alcohols, or combinations thereof and providing an amount of phosphorus to the lubricating composition; wherein a total base number (TBN) of the lubricating composition is from about 0.5 to about 20; and wherein the amount of phosphorus from the antiwear system relative to the TBN of the lubricating composition is about 150 or less.

In other approaches, the lubricating composition of the previous paragraph may include optional features or embodiments. These optional features or embodiments may include one or more of the following in any combination: wherein the amount of phosphorus from the antiwear system relative to the TBN is about 120 or less; and/or wherein the lubricating composition includes no more than about 800 ppm of phosphorus from the antiwear system; and/or wherein the lubricating composition includes no more than about 1800 ppm of metal from the detergent system; and/or wherein the amount of phosphorus from the antiwear system relative to the amount of metal from the detergent system is about 0.5 or less; and/or wherein the amount of phosphorus from the antiwear system relative to the lubricant TBN is effective so that the lubricating composition includes no more than about 0.8 weight percent of calculated sulfated ash and less than about 30 mg of deposits when subjected to the high temperature deposit formation test of ASTM D6335; and/or wherein the detergent system includes about 55 to about 75 weight percent of a detergent additive providing calcium and about 25 to about 45 weight percent of a detergent additive providing magnesium; and/or wherein the detergent system provides about 10 to about 1500 ppm of calcium and about 10 to about 500 ppm magnesium; and/or wherein the antiwear system includes two metal dialkyl dithiophosphates; and/or wherein the antiwear system includes two zinc dialkyl thiophosphates and wherein a first zinc dialkyl dithiophosphate is derived from primary alcohols and a second zinc dialkyl dithiophosphate is derived from secondary alcohols; and/or wherein the antiwear system includes a majority of the second zinc dialkyl dithiophosphate derived from secondary alcohols; and/or wherein the antiwear system includes about 20 to about 30 weight percent of the first zinc dialkyl dithiophosphate derived from primary alcohols and about 70 to about 80 weight percent of the second zinc dialkyl dithiophosphate derived from secondary alcohols; and/or wherein the detergent system includes a calcium sulfonate, calcium phenate, or combination thereof having a total base number of 200 to 500; and/or wherein detergent system includes a magnesium sulfonate, magnesium phenate, or combination thereof having a total base number of 200 to about 500; and/or wherein the total base number of the lubricating composition is less than about 10; and/or further comprising an amount of zinc provided by the antiwear system and wherein an amount of zinc from the antiwear system relative to the amount of total metals from the detergent system is about 0.6 or less; and/or wherein the antiwear system provides about 50 to about 850 ppm of zinc to the lubricating composition; and/or wherein the lubricating composition is a passenger car motor oil.

In another approach or embodiment, a low ash lubricating composition for reducing high temperature deposits is provided herein. In aspects, the low ash lubricating composition includes one or more base oil(s) of lubricating viscosity; a detergent system providing an amount of metal to the lubricant composition, where the metal is at least one of sodium, calcium, magnesium, or combinations thereof; an antiwear system including one or more metal dialkyl dithiophosphates derived from one of primary alcohols, secondary alcohols, or combinations thereof and providing an amount of phosphorus to the lubricating composition; and wherein the amount of phosphorus from the antiwear system relative to the amount of metal from the detergent system is about 0.5 or less.

The low ash lubricating composition of the previous paragraph may also include one or more optional features or embodiments. Those optional features or embodiments may include one or more of the following in any combination: wherein the lubricating composition includes no more than about 800 ppm of phosphorus from the antiwear system and no more than about 1800 ppm of metal from the detergent system; and/or wherein the amount of phosphorus from the antiwear system relative to the TBN is about 120 or less; and/or wherein the amount of phosphorus from the antiwear system relative to the lubricant TBN is effective so that the lubricating composition includes no more than about 0.8 weight percent of calculated sulfated ash and less than about 30 mg of deposits when subjected to the high temperature deposit formation test of ASTM D6335; and/or wherein the detergent system includes about 55 to about 75 weight percent of a detergent additive providing calcium and about 25 to about 45 weight percent of a detergent additive providing magnesium; and/or wherein the detergent system provides about 10 to about 1500 ppm of calcium and about 10 to about 500 ppm magnesium; and/or wherein the antiwear system includes two metal dialkyl dithiophosphates; and/or wherein the antiwear system includes two zinc dialkyl thiophosphates and wherein a first zinc dialkyl dithiophosphate is derived from primary alcohols and a second zinc dialkyl dithiophosphate is derived from secondary alcohols; and/or wherein the antiwear system includes a majority of the second zinc dialkyl dithiophosphate derived from secondary alcohols; and/or wherein the antiwear system includes about 20 to about 30 weight percent of the first zinc dialkyl dithiophosphate derived from primary alcohols and about 70 to about 80 weight percent of the second zinc dialkyl dithiophosphate derived from secondary alcohols; and/or wherein the detergent system includes a calcium sulfonate, calcium phenate, or combination thereof having a total base number of 200 to 500; and/or wherein detergent system includes a magnesium sulfonate, magnesium phenate, or combination thereof having a total base number of 200 to about 500; and/or wherein the total base number of the lubricating composition is less than about 10; and/or further comprising an amount of zinc provided by the antiwear system and wherein an amount of zinc from the antiwear system relative to the amount of total metals from the detergent system is about 0.6 or less; and/or wherein the antiwear system provides about 50 to about 850 ppm of zinc to the lubricating composition; and/or wherein the lubricating composition is a passenger car motor oil.

In yet another approach or embodiments, a method of lubricating an engine with a lubricating composition that meets API SP/ILSAC GF-6 standards. In aspects, the method includes lubricating the engine with a lubricating composition, the lubricating composition including one or more base oil(s) of lubricating viscosity; a detergent system providing an amount of metal to the lubricant composition, where the metal is at least one of sodium, calcium, magnesium, or combinations thereof; an antiwear system including one or more metal dialkyl dithiophosphates derived from one of primary alcohol, secondary alcohol, or combinations thereof and providing an amount of phosphorus to the lubricating composition; wherein a total base number (TBN) of the lubricating composition is from about 0.5 to about 20; and wherein the amount of phosphorus from the antiwear system relative to the TBN of the lubricating composition is about 150 or less; and wherein the lubricating composition has no more than about 0.8 weight percent of calculated sulfated ash and less than about 30 mg of deposits when subjected to the high temperature deposit formation test of ASTM D6335.

In other approaches or embodiments, the method of the previous paragraph may include optional features, embodiments, or method steps in any combination. The optional features, embodiments, or steps may include one or more of the following: wherein the lubricating composition includes no more than about 800 ppm of phosphorus from the antiwear system; and/or wherein the lubricating composition includes no more than about 1800 ppm of total metals from the detergent system; wherein the detergent system provides about 10 to about 1500 ppm of calcium and about 10 to about 500 ppm magnesium; and/or wherein the total base number of the lubricating composition is less than about 10; and/or wherein the antiwear system provides about 50 to about 850 ppm zinc to the lubricating composition and wherein an amount of zinc from the antiwear system relative to the amount of total metals from the detergent system is about 0.6 or less; and/or wherein the amount of phosphorus from the antiwear system relative to the TBN is about 120 or less; and/or wherein the amount of phosphorus from the antiwear system relative to the lubricant TBN is effective so that the lubricating composition includes no more than about 0.8 weight percent of calculated sulfated ash and less than about 30 mg of deposits when subjected to the high temperature deposit formation test of ASTM D6335; and/or wherein the detergent system includes about 55 to about 75 weight percent of a detergent additive providing calcium and about 25 to about 45 weight percent of a detergent additive providing magnesium; and/or wherein the detergent system provides about 10 to about 1500 ppm of calcium and about 10 to about 500 ppm magnesium; and/or wherein the antiwear system includes two metal dialkyl dithiophosphates; and/or wherein the antiwear system includes two zinc dialkyl thiophosphates and wherein a first zinc dialkyl dithiophosphate is derived from primary alcohols and a second zinc dialkyl dithiophosphate is derived from secondary alcohols; and/or wherein the antiwear system includes a majority of the second zinc dialkyl dithiophosphate derived from secondary alcohols; and/or wherein the antiwear system includes about 20 to about 30 weight percent of the first zinc dialkyl dithiophosphate derived from primary alcohols and about 70 to about 80 weight percent of the second zinc dialkyl dithiophosphate derived from secondary alcohols; and/or wherein the detergent system includes a calcium sulfonate, calcium phenate, or combination thereof having a total base number of 200 to 500; and/or wherein detergent system includes a magnesium sulfonate, magnesium phenate, or combination thereof having a total base number of 200 to about 500; and/or wherein the total base number of the lubricating composition is less than about 10; and/or further comprising an amount of zinc provided by the antiwear system and wherein an amount of zinc from the antiwear system relative to the amount of total metals from the detergent system is about 0.6 or less; and/or wherein the antiwear system provides about 50 to about 850 ppm of zinc to the lubricating composition; and/or wherein the lubricating composition is a passenger car motor oil.

In another approach or embodiment, use of any embodiment of the lubricating compositions of this Summary is provided for achieving less than 30 mg of deposits when subjected to the high temperature deposit formation test of ASTM D6335.

In other embodiments herein, any of the embodiments of the use, methods, or compositions herein may have a calculated sulfated ash (SASH) as calculated by the methods set forth below of less than about 0.8 weight percent, less than about 0.75 weight percent, less than about 0.7 weight percent, less than about 0.6 weight percent, less than about 0.5 weight percent, less than about 0.4 weight percent, less than about 0.3 weight percent, or even less than about 0.2 weight percent.

Other embodiments of the present disclosure will be apparent to those skilled in the art from consideration of the specification and practice of the invention disclosed herein. The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished lubrication product comprising a major amount of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," "motor oil concentrate," are considered synonymous, fully interchangeable terminology referring the portion of the lubricating oil composition excluding the major amount of base oil stock mixture. The additive package may or may not include the viscosity index improver or pour point depressant.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, salicylates, sulfonates, and/or phenols.

The term "alkaline earth metal" relates to calcium, barium, magnesium, and strontium, and the term "alkali metal" refers to lithium, sodium, potassium, rubidium, and cesium.

As used herein, the term "hydrocarbyl" or "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "hydrocarbylene substituent" or "hydrocarbylene group" is used in its ordinary sense, which is well-known to those skilled in the art. Specifically, it refers to a group that is directly attached at two locations of the molecule to the remainder of the molecule by a carbon atom and having predominantly hydrocarbon character. Each hydrocarbylene group is independently selected from divalent hydrocarbon substituents, and substituted divalent hydrocarbon substituents containing halo groups, alkyl groups, aryl groups, alkylaryl groups, arylalkyl groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents is present for every ten carbon atoms in the hydrocarbylene group.

As used herein, the term "percent by weight", unless expressly stated otherwise, means the percentage the recited component represents to the weight of the entire composition.

As used herein, the term "ppmw," unless expressly stated otherwise, refers to parts per million based on weight.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896.

The term "alkyl" as employed herein refers to straight, branched, cyclic, and/or substituted saturated chain moieties of from about 1 to about 100 carbon atoms. The term "alkenyl" as employed herein refers to straight, branched, cyclic, and/or substituted unsaturated chain moieties of from about 3 to about 10 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

As used herein, "post-reacted" or "post-treated" refers to a component that is further reacted with or treated with, for example, a boron, phosphorus, and/or maleic anhydride and may refer to dispersants in which primary and/or secondary amines are further reacted with such compounds to convert at least a portion of such amines to tertiary amines. Such subsequent reactions or treatments are further described in U.S. Pat. No. 5,241,003, which is incorporated herein by reference. Conversely, components that are "not post-reacted" or "not post-treated" have not been subjected to such further processing, reactions, and/or treatments and, in the context of dispersants, include a certain amount of primary and/or secondary amines.

The molecular weight for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

As used herein, "sulfated ash" or "SASH" refers to the amount of sulfated ash as calculated based on the amount of metals in the lubricant. For example, sulfated ash (SASH) is calculated based on the total metallic elements that contribute to SASH in the lubricant composition adjusted by factors for each metallic type. The metals that contribute to SASH include (along with the adjustment factor) barium (1.7), boron (3.22), calcium (3.4), copper (1.252), lead (1.464), lithium (7.92), magnesium (4.95), manganese (1.291), molybdenum (1.5), potassium (2.33), sodium (3.09), and zinc (1.5). Specifically, the ppmw content of each of the metallic elements present in a lubricating oil composition that is considered to contribute to sulfated ash is multiplied by its corresponding factor above; then, the product for each metallic element/factor adjustment is summed and the total is divided by 10,000 to calculate the weight percent of SASH in the lubricating compositions. Further details of such calculations are set-forth below in the Examples.

Additional details and advantages of the disclosure will be set forth in part in the description that follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

BRIEF DESCRIPTION OF DRAWING FIGURES

DETAILED DESCRIPTION

Figure 1:
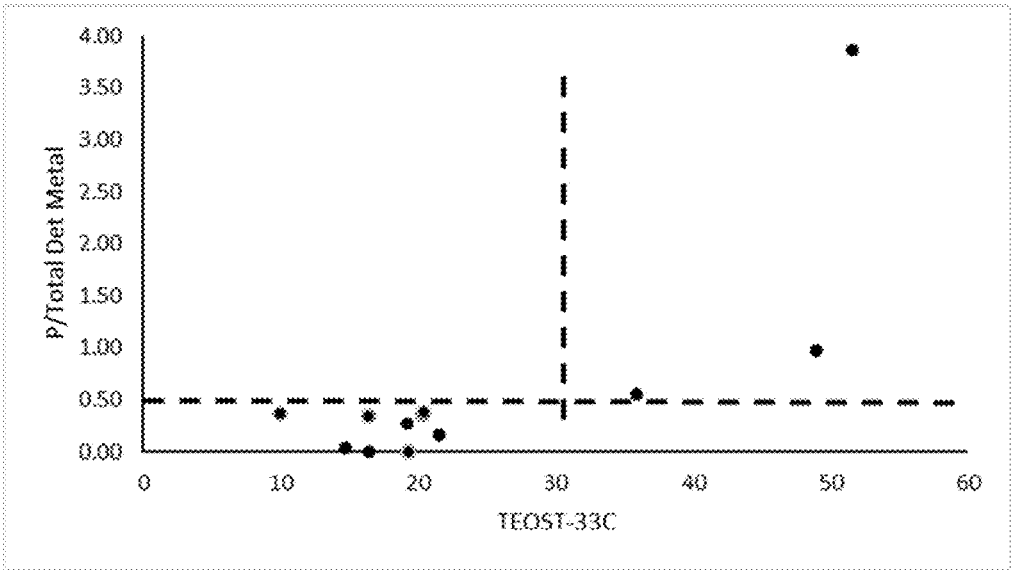
FIG. 1 is a plot of phosphorus amount to total detergent metals relative to the amount of high temperature deposits.

In one aspect, this disclosure describes blends of detergent and antiwear lubricating additives and lubricants including such additive blends suitable for and/or configured at least to API SP/ILSAC GF-6 standards. In one approach, the lubricating composition is effective to reduce high temperature deposits, and in particular, high temperature deposits in low ash compositions. As shown below in the Examples, reducing additives known to lower ash levels can be detrimental to high temperature deposits. However, improved high temperature deposit performance can be achieved in lubricant compositions having low levels of ash when certain relationships of detergent and antiwear features are maintained. For instance, the lubricating compositions herein include a base oil of lubricating viscosity; a detergent system providing an amount of metal to the lubricating composition, and preferably, a metal of at least sodium, calcium, magnesium, or combinations thereof; an antiwear system including one or more metal dialkyl dithiophosphates derived from one of primary alcohols, secondary alcohols, or combinations thereof and providing an amount of phosphorus to the lubricating composition; and wherein the lubricating compositions have a total base number (TBN) of about 0.5 to about 20.

Uniquely, embodiments of the lubricating compositions herein also include a distinctive relationship between an amount of phosphorus from the antiwear system relative to the TBN of the overall lubricating composition effective to achieve low high temperature deposits and, in embodiments, low high temperature deposits in compositions also having low levels of ash calculated as sulfated ash. In embodiments, the lubricating compositions have a ratio of the amount of the phosphorus from the antiwear system relative to the TBN of the lubricating composition of about 150 or less, which surprisingly achieves low high temperature deposits and, in particular, low high temperature deposits in lubricating compositions also having low levels of ash. In yet other approaches, the lubricating composition herein may also have an amount of phosphorus from the antiwear system relative to the amount of metal from the detergent system of about 0.5 or less, and in other approaches, about 0.38 or less in compositions effective to achieve low high temperature deposits in the low ash formulations. For instance, such relationships of phosphorus, TBN, and/or detergent metals are effective so that the lubricating compositions herein include less than about 30 mg of deposits when subjected to the high temperature deposit formation test of ASTM D6335 (i.e., TEOST-33C) and, at the same time, have no more than about 0.8 weight percent of calculated sulfated ash (as calculated pursuant to the descriptions herein). Each of the lubricant components will be described in more detail below.

The Detergent System

The lubricant compositions herein include a detergent system providing a source of metal, and preferably sodium, calcium, magnesium, or combinations thereof, from detergent additives such as phenates, sulfonates, salicylates, and the like detergents as discussed more below. Suitable detergents and their methods of preparation are described in greater detail in numerous patent publications, including U.S. Pat. No. 7,732,390 and references cited therein, which is incorporated herein by reference. The lubricant compositions herein may include up to about 3.0 weight percent or from about 0.01 to about 2.0 weight percent, and in other approaches, about 0.1 to about 1.5 weight percent of the detergent system so long as the compositions include the noted relationships of antiwear phosphorus to either lubricant TBN or detergent metal as further discussed herein.

As noted above and in some approaches, the detergent system provides select amounts of metal, preferably combinations of calcium and magnesium, to the lubricating composition. For instance, the detergent systems herein provide an amount of metal up to about 1800 ppm, up to about 1700 ppmw, up to about 1600 ppmw, up to about 1500 ppmw, up to about 1400 ppmw, up to about 1300 ppm metal, up to about 1200 ppmw metal, or up to about 1100 ppmw metal. In other instances, the detergent systems provide at least about 100 ppmw of the metal, at least about 200 ppmw of the metal, at least about 300 ppmw of the metal, or at least about 400 ppmw of the metal.

Preferably, the detergent system provides calcium and magnesium. In approaches, the detergent system includes about 55 to about 75 weight percent of a detergent additive providing calcium (in other approaches, about 60 to about 70 weight percent) and about 25 to about 45 weight percent of a detergent additive providing magnesium (in other approaches, about 30 to about 40 weight percent). The detergent systems, in other embodiments, may also provide about 10 to about 1500 ppm of calcium and about 10 to about 500 ppm magnesium to the lubricant compositions. In some approaches, the calcium and magnesium are both provided by sulfonate or phenate detergent additives (preferably sulfonate detergent additives) having a TBN of 0 to about 500, in other approaches, are overbased detergent additives having a TBN of about 180 to about 500, about 200 to about 450, or about 300 to about 425.

In general, the detergent substrates herein may be salted with an alkali or alkaline earth metal such as, but not limited to, calcium and magnesium as discussed above, but the detergents may also be salted with potassium, sodium, lithium, barium, zinc, or mixtures thereof as long as the detergent system meets the total metal and, in optional approaches, the calcium and magnesium requirements as noted herein. In one approach, suitable detergents in the system may include alkali or alkaline earth metal salts, such as, calcium or magnesium, of petroleum sulfonic acids and long chain mono- or di-alkylaryl sulfonic acids with the aryl group being benzyl, tolyl, and xylyl and/or various phenates or derivatives of phenates. Examples of suitable detergents include, but are not limited to low-based/neutral and/or overbased variations of the following detergents: calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

The detergents may be also be neutral to overbased and, preferably, overbased detergents. Overbased detergent additives are well-known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

As understood, the term "overbased" relates to metal salts, such as but not limited to metal salts of sulfonates, carboxylates, salicylates and/or phenates, wherein the amount of metal present exceeds the stoichiometric amount. Such salts may have a conversion level in excess of 100% (that is, they may comprise more than 100% of the theoretical amount of metal needed to convert the acid to its "normal," "neutral" salt). The expression "metal ratio," often abbreviated as MR, may be used to designate the ratio of total chemical equivalents of metal in the overbased salt to chemical equivalents of the metal in a neutral salt according to known chemical reactivity and stoichiometry. In a normal or neutral salt, the MR is one and in an overbased salt, MR, is greater than one. They are commonly referred to as overbased, hyperbased, or superbased salts and may be salts of organic sulfur acids, carboxylic acids, or phenols.

As used herein, the term "TBN" is used to denote the Total Base Number in mg KOH/g as measured by the method of ASTM D2896. An overbased detergent of the lubricating oil composition may have a total base number (TBN) of about 200 mg KOH/gram or greater, or about 250 mg KOH/gram or greater, or about 350 mg KOH/gram or greater, or about 375 mg KOH/gram or greater, or about 400 mg KOH/gram or greater. The overbased detergent may have a metal to substrate ratio of from 1.1:1, or from 2:1, or from 4:1, or from 5:1, or from 7:1, or from 10:1.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The detergents may also be low-based or even neutral detergents. For instance, the low-based or neutral detergent if used in the systems herein generally have a TBN of up to 175 mg KOH/g, up to 150 mg KOH/g, up to 100 mg KOH/g, or up to 50 mg KOH/g. The low-based/neutral detergent may include a calcium or magnesium-containing detergent. Examples of suitable low-based/neutral detergent include, but are not limited to, calcium sulfonates, calcium phenates, calcium salicylates, magnesium sulfonates, magnesium phenates, and/or magnesium salicylates.

In embodiments, the detergent systems include combinations of calcium sulfonate and magnesium sulfonate, but are not necessary limited to such detergent combinations. In approaches, the calcium sulfonate of the detergent systems herein is preferably an overbased detergent and, in approaches, has a total base number of about 200 to about 500 and, in other approaches, about 300 to about 450. In other approaches, the magnesium sulfonate of the detergent systems herein is preferably also an overbased detergent with a total base number of about 200 to about 500 and, in other approaches, about 300 to about 425.

The Antiwear System

The lubricating compositions herein also include an antiwear system in combination with the detergent system discussed above. The antiwear system provides a mixture of antiwear metal and phosphorus effective to achieve, among other features, friction performance and surprisingly, the high temperature deposit performance when balanced relative to the detergent system features. The lubricant compositions herein may include up to about 3.0 weight percent of the antiwear system or from about 0.01 to about 2.0 weight percent, and in other approaches, about 0.1 to about 1.5 weight percent of the antiwear system so long as the compositions include the noted relationships of antiwear phosphorus to either lubricant TBN or detergent metal as further discussed herein.

In approaches, the antiwear system includes a mixture of two or more metal dihydrocarbyl dithiophosphate compounds, such as but not limited to, two or more zinc dihydrocarbyl dithiophosphate compounds (ZDDP). Suitable metal dithiophosphates, such as ZDDP, may each include between about 5 to about 10 weight percent metal (in other approaches, about 6 to about 9 weight percent metal where the metal is preferably zinc), and about 8 to about 18 weight percent sulfur (in other approaches, about 12 to about 18 weight percent sulfur, or about 8 to about 15 weight percent sulfur). The metal dithiophosphates, such as ZDDP, may also include about 5 to about 10 weight percent phosphorus. Suitable metal dihydrocarbyl dithiophosphates may be any of the dihydrocarbyl dithiophosphate metal salts wherein the metal may be an alkali metal, alkaline earth metal, aluminum, lead, tin, molybdenum, manganese, nickel, copper, titanium, zirconium, zinc, or combinations thereof. However, the metal is preferably zinc.

When the phosphorus-containing compounds of the antiwear system is a ZDDP, the alkyl groups on ZDDP may be derived from primary alcohols, secondary alcohols, and/or mixtures thereof. For example, primary alcohols suitable for forming the alkyl groups of the ZDDP include, but are not limited to, ethyl hexyl alcohol, butanol, and/or C6 and higher primary alcohols. Secondary alcohols suitable for forming the alkyl groups of the ZDDP include, but are not limited to, methyl isobutyl carbinol, isopropyl alcohol, or mixtures thereof. In some cases, the alkyl groups of the ZDDP may be derived from a mixture of primary and secondary alcohols, such as 2-ethyl hexanol (primary), isobutanol (primary), and isopropanol (secondary). For example and in one embodiment, one the ZDDP additives in the antiwear system includes about alkyl groups derived from C6 to C8 primary alcohols, and in particular ethyl hexyl alcohol. In other embodiments, a second ZDDP of the antiwear system includes all alkyl groups derived from secondary alcohols, such as methyl isobutyl carbinol and the like. In one approach, the antiwear systems herein includes a mixture of metal dialkyl dithiophosphates (preferably zinc dialkyl dithiophosphates) derived from primary and secondary alcohols. In embodiments, a weight ratio of the primary to the secondary alcohols from the two ZDDP additives combined in the antiwear system is at least about 0.25:1.0 to about 0.5:1.0, and in other approaches, about 0.3:1 to about 0.4:1 as discussed more below.

Examples of suitable ZDDPs include, but are not limited to: zinc O,O-di($C_{1-14}$-alkyl)dithiophosphate; zinc (mixed O,O-bis(sec-butyl and isooctyl)) dithiophosphate; zinc-O,O-bis(branched and linear $C_{3-8}$-alkyl)dithiophosphate; zinc O,O-bis(2-ethylhexyl)dithiophosphate; zinc O,O-bis(mixed isobutyl and pentyl)dithiophosphate; zinc mixed O,O-bis(1,3-dimethylbutyl and isopropyl)dithiophosphate; zinc O,O-diisooctyl dithiophosphate; zinc O,O-dibutyl dithiophosphate; zinc mixed O,O-bis(2-ethylhexyl and isobutyl and isopropyl)dithiophosphate; zinc O,O-bis(dodecylphenyl)dithiophosphate; zinc O,O-diisodecyl dithiophosphate; zinc O-(6-methylheptyl)-O-(1-methylpropyl)dithiophosphate; zinc O-(2-ethylhexyl)-O-(isobutyl)dithiophosphate; zinc O,O-diisopropyl dithiophosphate; zinc (mixed hexyl and isopropyl)dithiophosphate; zinc (mixed O-(2-ethylhexyl) and O-isopropyl) dithiophosphate; zinc O,O-dioctyl dithiophosphate; zinc O,O-dipentyl dithiophosphate; zinc O-(2-methylbutyl)-O-(2-methylpropyl)dithiophosphate; and zinc O-(3-methylbutyl)-O-(2-methylpropyl)dithiophosphate.

In yet other approaches, each of the phosphorus-containing compounds in the antiwear system herein may each have the structure of Formula I (Formula I)

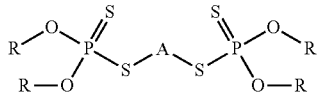

wherein R in Formula I independently contains from 1 to 18 carbon atoms, or 2 to 12 carbon atoms, or about 3 to 8 carbon atoms. The antiwear system may contain two compounds of the structure of Formula I. In each compound, R may be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl as needed to meet the select ratio of primary to secondary alcohols noted above in the antiwear system. In some embodiment, the number of carbon atoms in each R group in Formula I above will generally be about 3 or greater, about 4 or greater, about 6 or greater, or about 8 or greater. Each R group may average 3 to 8 carbons. The total number of carbon atoms in the R groups may be 5 to about 72, or 12 to about 32. In Formula I, A is a metal, such as aluminum, lead, tin, molybdenum, manganese, nickel, copper, titanium, zirconium, zinc, or combinations thereof. Preferably, A is zinc.

In yet other approaches, the zinc dialkyl dithiophosphate of the antiwear system have a sulfur-zinc coordination arrangement of the phosphorus compounds in the antiwear systems shown below the chemical structure of Formula II, which may be interchangeable with Formula I shown above. It is also understood that the structures shown in Formulas I and II may be present as monomer, dimer, trimer, or oligomer (such as a tetramer).

(Formula II)

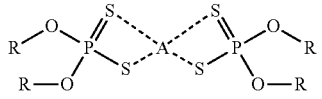

In some embodiments, each phosphorous-containing compound of the antiwear system has the structure of Formula I wherein A is zinc and the combined total of the compounds within the antiwear system provide about 70 to about 800 ppm phosphorus to the lubricant composition (and in other approaches, about 250 to about 800 ppm) and about 50 to about 850 ppm of zinc. As noted above, the antiwear system includes a mixture of zinc dialkyl dithiophosphates. Preferably, the antiwear system may include at least two zinc dialkyl dithiophosphates where a first zinc dialkyl dithiophosphate is derived only from primary alcohols and a second zinc dialkyl dithiophosphate is derived from secondary alcohols. Preferably, the antiwear system includes a majority of the secondary zinc dialkyl dithiophosphate derived only from the secondary alcohols, such as wherein a weight ratio of primary to secondary alcohols forming the ZDDPs within the antiwear mixture (that is, all compounds of the antiwear mixture) is at least 0.25:1.0 (that is, about 70 to about 80% of all alkyl groups in the antiwear mixture is from secondary alcohols and about 20 to about 30% of alkyl groups in the antiwear mixture is from a primary alcohol). In other approaches, the ratio of primary to secondary alcohols forming the ZDDPs within the antiwear mixture is at least about 0.25:1.0 to about 0.5:1.0, and in other approaches, about 0.3:1 to about 0.4:1.

In approaches, the lubricating compositions herein provide an amount of phosphorus and, in embodiments, have an antiwear system providing no more than about 800 ppm phosphorus to the lubricating compositions. In other approaches, the antiwear systems provide no more than about 700 ppm phosphorus, no more than about 500 ppm of phosphorus, no more than 400 ppm of phosphorus, or no more than about 300 ppm of phosphorus. In yet other approaches, the antiwear systems provide at least about 50 ppm of phosphorus, at least about 75 ppm of phosphorus, or at least about 100 ppm of phosphorus.

In other approaches, the lubricating compositions herein provide an amount of antiwear metal (preferably zinc) and, in embodiments, have an antiwear system providing no more than about 850 ppm zinc to the lubricating compositions. In other approaches, the antiwear systems provide no more than about 800 ppm zinc, no more than about 700 ppm of zinc, no more than 500 ppm of zinc, or no more than about 400 ppm of zinc. In yet other approaches, the antiwear systems provide at least about 50 ppm of zinc, at least about 75 ppm of zinc, or at least about 100 ppm of zinc. In embodiments, the lubricating compositions herein including an amount of zinc provided by the antiwear system relative to the amount of total metals from the detergent system of about 0.6 or less.

Dihydrocarbyl dithiophosphate metal salts may be prepared in accordance with known techniques by first forming a dihydrocarbyl dithiophosphoric acid (DDPA), usually by reaction of one or more alcohols or phenols with $P_2S_5$ and then neutralizing the formed DDPA with a metal compound, such as zinc oxide. For example, DDPA may be made by reacting mixtures of primary and secondary alcohols with $P_2S_5$. In this case, the DDPA includes alkyl groups derived from both primary and secondary alcohols. Alternatively, multiple DDPAs can be prepared where the alkyl groups on one DDPA are derived entirely from secondary alcohols and the alkyl groups on another DDPA are derived entirely from primary alcohols. The DDPAs are then blended together to form a mixture of DDPAs having alkyl groups derived from both primary and secondary alcohols.

Lubricating Oil Compositions

The detergent system and antiwear system described above may be combined with a major amount of a base oil or base oil blend of lubricating viscosity (as described below) in combination with one or more further optional additives to produce a lubricating oil composition. In approaches, the lubricating oil compositions includes about 50 weight percent or more of the base oil blend, about 60 weight percent or more, about 70 weight percent or more, or about 80 weight percent or more to about 95 weight percent or less, about 90 weight percent or less, about 85 weight percent or less of the base oil blend as such blend is further discussed below.

As noted above, the lubricating oil compositions include unique relationships between the phosphorus provided from the antiwear system relative to either (i) the TBN of the overall lubricating composition, (ii) the amount of total detergent metals (preferably calcium and/or magnesium), and/or (iii) both ratios effective to reduce and/or maintain low levels of high temperature deposits and, in particular, low levels of high temperature deposits in the context of lubricating compositions having low levels of ash calculated sulfated ash, such as lubricating compositions having no more than about 0.8 weight percent of calculated sulfated ash.

For instance, the overall lubricating compositions herein preferably have a total base number (TBN) of about 0.5 to about 20 (in other approaches, about 0.5 to about 10) and, in the context of the detergent and the antiwear systems described above, a specific relationship between the amount of phosphorus from the antiwear system relative to the TBN of the lubricating composition of about 150 or less, or in other embodiments, the amount of phosphorus from the antiwear system relative to the lubricant TBN of about 120 or less (preferably about 10 or greater, about 20 or greater, about 50 or greater, or about 80 or greater, or even about 80 or greater). In yet other embodiments, the amount of phosphorus from the antiwear system relative to the amount of metal from the detergent system may be about 0.5 or less, or even about 0.38 or less (preferably about 0.02 or greater, about 0.05 or greater, about 0.1 or greater, or about 0.2 or greater, or even about 0.25 or greater). With such relationships, the lubricating compositions herein have less than about 30 mg of deposits when subjected to the high temperature deposit formation test of ASTM D6335 (TEOST-33C) and, in the context of low ash compositions, include no more than about 0.8 weight percent of calculated sulfated ash (or about 0.1 to about 0.8 weight percent of calculated sulfated ash).

Base Oil Blend: The base oil used in the lubricating oil compositions herein may be oils of lubricating viscosity and selected from any of the base oils in Groups I-V as specified in the American Petroleum Institute (API) Base Oil Interchangeability Guidelines. The five base oil groups are as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil blend used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(l-hexenes), poly(l-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

Optional Additives:

The lubricating oil compositions herein may also include a number of optional additives combined with the dispersant system, antioxidant system, and antiwear system discussed above as needed to meet performance standards so long as the noted relationships for nitrogen and nitrogen source are maintained. Those optional additives are described in the following paragraphs.

Optional Dispersants: The lubricating oil composition may optionally include one or more additional dispersants or mixtures thereof. Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with the number average molecular weight of the polyisobutylene substituent being in the range about 350 to about 50,000, or to about 5,000, or to about 3,000, as measured by GPC. Succinimide dispersants and their preparation are disclosed, for instance in U.S. Pat. No. 7,897,696 or 4,234,435. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

Preferred amines are selected from polyamines and hydroxyamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like.

A suitable heavy polyamine is a mixture of polyalkylenepolyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogen atoms per molecule and with 2 or more primary amines per molecule. The heavy polyamine comprises more than 28 wt. % (e.g. >32 wt. %) total nitrogen and an equivalent weight of primary amine groups of 120-160 grams per equivalent.

In some approaches, suitable polyamines are commonly known as PAM and contain a mixture of ethylene amines where TEPA and pentaethylene hexamine (PEHA) are the major part of the polyamine, usually less than about 80%.

Typically, PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogen atoms and more extensive branching, may produce dispersants with improved dispersancy.

In an embodiment the present disclosure further comprises at least one polyisobutylene succinimide dispersant derived from polyisobutylene with a number average molecular weight in the range about 350 to about 50,000, or to about 5000, or to about 3000, as determined by GPC. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable, as determined by GPC. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment, the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights determined by gel permeation chromatography (GPC) using commercially available polystyrene standards (with a number average molecular weight of 180 to about 18,000 as the calibration reference).

In one embodiment, the dispersant may be derived from a polyalphaolefin (PAO) succinic anhydride. In one embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

A suitable class of nitrogen-containing dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

One class of suitable dispersants may also be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may also be high molecular weight esters or half ester amides. A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with: Inorganic phosphorous acids or anhydrates (e.g., U.S. Pat. Nos. 3,403,102 and 4,648,980); Organic phosphorous compounds (e.g., U.S. Pat. No. 3,502,677); Phosphorous pentasulfides; Boron compounds as already noted above (e.g., U.S. Pat. Nos. 3,178,663 and 4,652,387); Carboxylic acid, polycarboxylic acids, anhydrides and/or acid halides (e.g., U.S. Pat. Nos. 3,708,522 and 4,948,386); Epoxides polyepoxiates or thioexpoxides (e.g., U.S. Pat. Nos. 3,859,318 and 5,026,495); Aldehyde or ketone (e.g., U.S. Pat. No. 3,458,530); Carbon disulfide (e.g., U.S. Pat. No. 3,256,185); Glycidol (e.g., U.S. Pat. No. 4,617,137); Urea, thiourea or guanidine (e.g., U.S. Pat. Nos. 3,312,619; 3,865,813; and British Patent GB 1,065,595); Organic sulfonic acid (e.g., U.S. Pat. No. 3,189,544 and British Patent GB 2,140,811); Alkenyl cyanide (e.g., U.S. Pat. Nos. 3,278,550 and 3,366,569); Diketene (e.g., U.S. Pat. No. 3,546,243); A diisocyanate (e.g., U.S. Pat. No. 3,573,205); Alkane sultone (e.g., U.S. Pat. No. 3,749,695); 1,3-Dicarbonyl Compound (e.g., U.S. Pat. No. 4,579,675); Sulfate of alkoxylated alcohol or phenol (e.g., U.S. Pat. No. 3,954,639); Cyclic lactone (e.g., U.S. Pat. Nos. 4,617,138; 4,645,515; 4,668,246; 4,963,275; and 4,971,711); Cyclic carbonate or thiocarbonate linear monocarbonate or polycarbonate, or chloroformate (e.g., U.S. Pat. Nos. 4,612,132; 4,647,390; 4,648,886; 4,670,170); Nitrogen-containing carboxylic acid (e.g., U.S. Pat. No. 4,971,598 and British Patent GB 2,140,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603 and 4,666,460); Cyclic carbonate or thiocarbonate, linear monocarbonate or polycarbonate, or chloroformate (e.g., U.S. Pat. Nos. 4,612,132; 4,647,390; 4,646,860; and 4,670,170); Nitrogen-containing carboxylic acid (e.g., U.S. Pat. No. 4,971,598 and British Patent GB 2,440,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603, and 4,666,460); Cyclic carbamate, cyclic thiocarbamate or cyclic dithiocarbamate (e.g., U.S. Pat. Nos. 4,663,062 and 4,666,459); Hydroxyaliphatic carboxylic acid (e.g., U.S. Pat. Nos. 4,482,464; 4,521,318; 4,713,189); Oxidizing agent (e.g., U.S. Pat. No. 4,379,064); Combination of phosphorus pentasulfide and a polyalkylene polyamine (e.g., U.S. Pat. No. 3,185,647); Combination of carboxylic acid or an aldehyde or ketone and sulfur or sulfur chloride (e.g., U.S. Pat. Nos. 3,390,086; 3,470,098); Combination of a hydrazine and carbon disulfide (e.g. U.S. Pat. No. 3,519,564); Combination of an aldehyde and a phenol (e.g., U.S. Pat. Nos. 3,649,229; 5,030,249; 5,039,307); Combination of an aldehyde and an O-diester of dithiophosphoric acid (e.g., U.S. Pat. No. 3,865,740); Combination of a hydroxyaliphatic carboxylic acid and a boric acid (e.g., U.S. Pat. No. 4,554,086); Combination of a hydroxyaliphatic carboxylic acid, then formaldehyde and a phenol (e.g., U.S. Pat. No. 4,636,322); Combination of a hydroxyaliphatic carboxylic acid and then an aliphatic dicarboxylic acid (e.g., U.S. Pat. No. 4,663,064); Combination of formaldehyde and a phenol and then glycolic acid (e.g., U.S. Pat. No. 4,699,724); Combination of a hydroxyaliphatic carboxylic acid or oxalic acid and then a diisocyanate (e.g. U.S. Pat. No. 4,713,191); Combination of inorganic acid or anhydride of phosphorus or a partial or total sulfur analog thereof and a boron compound (e.g., U.S. Pat. No. 4,857,214); Combination of an organic diacid then an unsaturated fatty acid and then a nitrosoaromatic amine optionally followed by a boron compound and then a glycolating agent (e.g., U.S. Pat. No. 4,973,412); Combination of an aldehyde and a triazole (e.g., U.S. Pat. No. 4,963,278); Combination of an aldehyde and a triazole then a boron compound (e.g., U.S. Pat. No. 4,981,492); Combination of cyclic lactone and a boron compound (e.g., U.S. Pat. Nos. 4,963,275 and 4,971,711). The above-mentioned patents are herein incorporated in their entireties.

The TBN of a suitable dispersant may be from about 10 to about 65 mg KOH/g dispersant, on an oil-free basis, which is comparable to about 5 to about 30 TBN if measured on a dispersant sample containing about 50% diluent oil. TBN is measured by the method of ASTM D2896.

In yet other embodiments, the optional dispersant additive may be a hydrocarbyl substituted succinamide or succinimide dispersant. In approaches, the hydrocarbyl substituted succinamide or succinimide dispersant may be derived from a hydrocarbyl substituted acylating agent reacted with a polyalkylene polyamine and wherein the hydrocarbyl substituent of the succinamide or the succinimide dispersant is a linear or branched hydrocarbyl group having a number average molecular weight of about 250 to about 5,000 as measured by GPC using polystyrene as a calibration reference.

In some approaches, the polyalkylene polyamine used to form the dispersant has the Formula

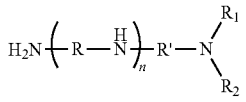

wherein each R and R', independently, is a divalent C1 to C6 alkylene linker, each $R_1$ and $R_2$, independently, is hydrogen, a C1 to C6 alkyl group, or together with the nitrogen atom to which they are attached form a 5- or 6-membered ring optionally fused with one or more aromatic or non-aromatic rings, and n is an integer from 0 to 8. In other approaches, the polyalkylene polyamine is selected from the group consisting of a mixture of polyethylene polyamines having an average of 5 to 7 nitrogen atoms, triethylenetetramine, tetraethylenepentamine, and combinations thereof.

The optional dispersant, if present, can be used in an amount sufficient to provide up to about 20 wt %, based upon the final weight of the lubricating oil composition. Another amount of the dispersant that can be used may be about 0.1 wt % to about 15 wt %, or about 0.1 wt % to about 10 wt %, about 0.1 to 8 wt %, or about 1 wt % to about 10 wt %, or about 1 wt % to about 8 wt %, or about 1 wt % to about 6 wt %, based upon the final weight of the lubricating oil composition. In some embodiments, the lubricating oil composition utilizes a mixed dispersant system. A single type or a mixture of two or more types of dispersants in any desired ratio may be used.

Additional Antioxidants: The lubricating oil compositions herein also may optionally contain one or more further antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenyl amine, octyl diphenylamine, di-octyl diphenyl amine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butyl phenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butyl acrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

In another alternative embodiment the antioxidant composition also contains a molybdenum-containing antioxidant in addition to the phenolic and/or aminic antioxidants discussed above. When a combination of these three antioxidants is used, preferably the ratio of phenolic to aminic to molybdenum-containing is (0 to 2):(0 to 2):(0 to 1).

The one or more antioxidant(s) may be present in ranges about 0 wt % to about 20 wt %, or about 0.1 wt % to about 10 wt %, or about 1 wt % to about 5 wt %, of the lubricating oil composition.

Further Antiwear Agents: The lubricating oil compositions herein also may optionally contain one or more further antiwear agents. Examples of suitable additional antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkyldithiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Boron-Containing Compounds: The lubricating oil compositions herein may optionally contain one or more boron-containing compounds. Examples of boron-containing compounds include borate esters, borated fatty amines, borated epoxides, borated detergents, and borated dispersants, such as borated succinimide dispersants, as disclosed in U.S. Pat. No. 5,883,057. The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the lubricating oil composition.

Additional Detergents: The lubricating oil composition may optionally further comprise one or more additional neutral, low based, or overbased detergents, and mixtures thereof. Suitable additional detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

An overbased detergent of the lubricating oil composition may have a total base number (TBN) of about 200 mg KOH/gram or greater, or as further examples, about 250 mg KOH/gram or greater, or about 350 mg KOH/gram or greater, or about 375 mg KOH/gram or greater, or about 400 mg KOH/gram or greater.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased calcium phenate detergents have a total base number of at least about 150 mg KOH/g, at least about 225 mg KOH/g, at least about 225 mg KOH/g to about 400 mg KOH/g, at least about 225 mg KOH/g to about 350 mg KOH/g or about 230 mg KOH/g to about 350 mg KOH/g, all as measured by the method of ASTM D-2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

The overbased detergent may have a metal to substrate ratio of from 1.1:1, or from 2:1, or from 4:1, or from 5:1, or from 7:1, or from 10:1. In some embodiments, a detergent is effective at reducing or preventing rust in an engine or other automotive part such as a transmission or gear. The detergent may be present in a lubricating composition at about 0 wt % to about 10 wt %, or about 0.1 wt % to about 8 wt %, or about 1 wt % to about 4 wt %, or greater than about 4 wt % to about 8 wt %.

Extreme Pressure Agents: The lubricating oil compositions herein also may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; organic sulfides and polysulfides such as dibenzyldisulfide, bis(chlorobenzyl) disulfide, dibutyl tetrasulfide, sulfurized methyl ester of oleic acid, sulfurized alkyl phenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers: The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a diester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt % to about 10 wt %, or about 0.01 wt % to about 8 wt %, or about 0.1 wt % to about 4 wt %.

Molybdenum-containing component: The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan® 822™, Molyvan®™ A, Molyvan® 2000 and Molyvan® 855, and Molyvan® 1055 from R. T. Vanderbilt Co., Ltd., and Sakura-Lube™ S-165, S-200, S-300, S-310G, S-151, S-525, S-600, S-700, and S-710 available from Adeka Corporation, and mixtures thereof. Suitable molybdenum components are described in U.S. Pat. No. 5,650,381; U.S. RE 37,363 E1; U.S. RE 38,929 E1; and U.S. RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, MoOCl4, MoO2Br2, Mo2O3Cl6, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula Mo3SkLnQz and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Transition Metal-containing compounds: In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., di alkyl dithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl-(or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

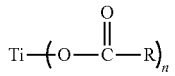

wherein n is an integer selected from 2, 3 and 4, and R is a hydrocarbyl group containing from about 5 to about 24 carbon atoms, or by the formula:

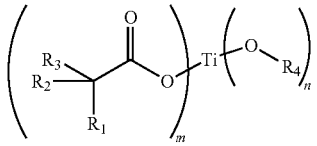

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or the titanium compound may be represented by the formula:

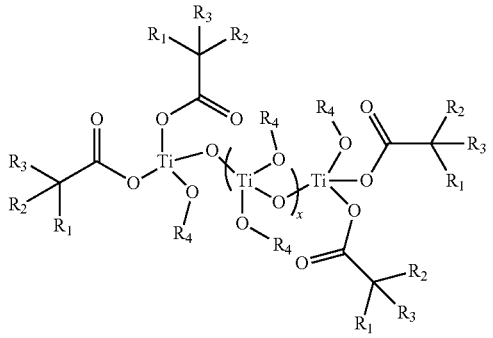

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or $C_6$ to $C_{25}$ carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium by weight or 25 to about 1500 ppm titanium by weight or about 35 ppm to 500 ppm titanium by weight or about 50 ppm to about 300 ppm.

Viscosity Index Improvers: The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, of the lubricating oil composition.

Other Optional Additives: Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid.

The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, a suitable lubricant including the neutral to overbased and sulfurized alkyl phenate product herein may include additive components in the ranges listed in the following table.

TABLE 2

Suitable Lubricating Compositions

| Component | Wt. % (Suitable Embodiments) | Wt. % (Suitable Embodiments) |
|---|---|---|
| Succinimide Dispersant(s) | 1.0-8.0 | 2.5-5.5 |
| Antioxidant(s) | 0.3-4.0 | 0.5-3.0 |
| Detergent(s) | 0.5-4.0 | 0.75-3.0 |
| Antiwear (ZDDP) | 0.1-2.0 | 0.5-1.5 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.0-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) | 0.0-25.0 | 0.1-15.0 |
| Dispersant viscosity index improver(s) | 0.0-10.0 | 0.0-5.0 |
| Friction modifier(s) | 0.0-5.0 | 0.01-2.0 |
| Base oil | Balance | Balance |
| Total | 100 | 100 |

The percentages of each component above represent the weight percent of each component, based upon the weight of the final lubricating oil composition. The remainder of the lubricating oil composition consists of one or more base oils. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). Fully formulated lubricants conventionally contain an additive package, referred to herein as a dispersant/inhibitor package or DI package, that will supply the characteristics that are required in the formulation.

Lubricants herein are configured for use in various types of lubricants, such as automotive lubricants and/or greases, internal combustion engine oils, hybrid engine oils, electric engine lubricants, drivetrain lubricants, transmission lubricants, gear oils, hydraulic lubricants, tractor hydraulic fluids, metal working fluids, turbine engine lubricants, stationary engine lubricants, tractor lubricants, motorcycle lubricants, power steering fluids, clutch fluids, axles fluids, wet break fluids, and the like. Suitable engine types may include, but are not limited to heavy-duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. A diesel engine may be a compression-ignited engine. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines (such as inland marine), aviation piston engines, low-load diesel engines, and motorcycle, automobile, locomotive, and truck engines. Engines may be coupled with a turbocharger.

The lubricating oil composition for an internal combustion engine may be suitable for any engine lubricant irrespective of the sulfur, phosphorus, or ash calculated as sulfated ash (ASTM D-874) content. The sulfur content of the engine oil lubricant may be about 1 wt % or less, or about 0.8 wt % or less, or about 0.5 wt % or less, or about 0.3 wt % or less, or about 0.2 wt % or less. In one embodiment the sulfur content may be in the range of about 0.001 wt % to about 0.5 wt %, or about 0.01 wt % to about 0.3 wt %. The phosphorus content may be about 0.2 wt % or less, or about 0.1 wt % or less, or about 0.085 wt % or less, or about 0.08 wt % or less, or even about 0.06 wt % or less, about 0.055 wt % or less, or about 0.05 wt % or less. In one embodiment, the phosphorus content may be about 50 ppm to about 1000 ppm, or about 325 ppm to about 850 ppm. The total sulfated ash content may be about 2 wt % or less, or about 1.5 wt % or less, or about 1.1 wt % or less, or about 1 wt % or less, or about 0.8 wt % or less, or about 0.5 wt % or less. In one embodiment the sulfated ash content may be about 0.05 wt % to about 0.9 wt %, or about 0.1 wt % or about 0.2 wt % to about 0.45 wt %. In another embodiment, the sulfur content may be about 0.4 wt % or less, the phosphorus content may be about 0.08 wt % or less, and the sulfated ash is about 1 wt % or less. In yet another embodiment the sulfur content may be about 0.3 wt % or less, the phosphorus content is about 0.05 wt % or less, and the sulfated ash may be about 0.8 wt % or less.

Further, lubricants of the present description may be suitable to meet one or more industry specification requirements such as ILSAC GF-3, GF-4, GF-5, GF-6, PC-11, CF, CF-4, CH-4, CK-4, FA-4, CJ-4, CI-4 Plus, CI-4, API SG, SJ, SL, SM, SN, SN PLUS, ACEA A1/B1, A2/B2, A3/B3, A3/B4, A5/B5, A7/B7, C1, C2, C3, C4, C5, C6, E4/E6/E7/E9, Euro 5/6, JASO DL-1, Low SAPS, Mid SAPS, or original equipment manufacturer specifications such as Dexos1™, Dexos2™, MB-Approval 229.1, 229.3, 229.5, 229.51/229.31, 229.52, 229.6, 229.71, 226.5, 226.51, 228.0/.1, 228.2/.3, 228.31, 228.5, 228.51, 228.61, VW 501.01, 502.00, 503.00/503.01, 504.00, 505.00, 505.01, 506.00/506.01, 507.00, 508.00, 509.00, 508.88, 509.99, BMW Longlife-01, Longlife-01 FE, Longlife-04, Longlife-12 FE, Longlife-14 FE+, Longlife-17 FE+, Porsche A40, C30, Peugeot Citroën Automobiles B71 2290, B71 2294, B71 2295, B71 2296, B71 2297, B71 2300, B71 2302, B71 2312, B71 2007, B71 2008, Renault RN0700, RN0710, RN0720, Ford WSS-M2C153-H, WSS-M2C930-A, WSS-M2C945-A, WSS-M2C913A, WSS-M2C913-B, WSS- M2C913-C, WSS-M2C913-D, WSS-M2C948-B, WSS-M2C948-A, GM 6094-M, Chrysler MS-6395, Fiat 9.55535 G1, G2, M2, N1, N2, Z2, S1, S2, S3, S4, T2, DS1, DSX, GH2, GS1, GSX, CR1, Jaguar Land Rover STJLR.03.5003, STJLR.03.5004, STJLR.03.5005, STJLR.03.5006, STJLR.03.5007, STJLR.51.5122 or any past or future PCMO or HDD specifications not mentioned herein. In some embodiments for passenger car motor oil (PCMO) applications, the amount of phosphorus in the finished fluid is 1000 ppm or less or 900 ppm or less or 800 ppm or less.

In one embodiment, the lubricating oil composition is an engine oil, wherein the lubricating oil composition may have (i) a sulfur content of about 0.5 wt % or less, (ii) a phosphorus content of about 0.1 wt % or less, and (iii) ash calculated as sulfated ash content of about 1.5 wt % or less.

In one embodiment, the lubricating oil composition is suitable for a 2-stroke or a 4-stroke marine diesel internal combustion engine. In one embodiment, the marine diesel combustion engine is a 2-stroke engine. In some embodiments, the lubricating oil composition is not suitable for a 2-stroke or a 4-stroke marine diesel internal combustion engine for one or more reasons, including but not limited to, the high sulfur content of fuel used in powering a marine engine and the high TBN required for a marine-suitable engine oil (e.g., above about 40 TBN in a marine-suitable engine oil).

In some embodiments, the lubricating oil composition is suitable for use with engines powered by low sulfur fuels, such as fuels containing about 1 to about 5% sulfur. Highway vehicle fuels contain about 15 ppm sulfur (or about 0.0015% sulfur).

EXAMPLES

The following examples are illustrative of exemplary embodiments of the disclosure. In these examples, as well as elsewhere in this application, all ratios, parts, and percentages are by weight unless otherwise indicated. It is intended that these examples are being presented for the purpose of illustration only and are not intended to limit the scope of the invention disclosed herein.

Comparative Example 1

A Comparative Lubricating Composition C1 was evaluated for high temperature deposits using ASTM 6335. Table 2 below shows the detergent and antiwear systems included in the Comparative Lubricating Composition, which was formulated into a finished lubricant also including dispersant(s), antioxidant(s), organo-molybdenum additive(s), antifoam additive(s), friction modifier(s), olefin copolymer viscosity modifier(s), pour point dispersant(s), process oil(s) and base oil(s).

TABLE 2

| Comparative Lubricating Composition (C1) | |
|---|---|
| Detergent System | |
| Calcium sulfonate (300 TBN) | 1.0% |
| Magnesium Sulfonate (400 TBN) | 0.4% |
| Antiwear System | |
| ZDDP A (100% MIBC) | 0.7% |
| ZDDP B (100% ethyl hexyl alcohol) | 0.23% |

TABLE 2-continued

| Comparative Lubricating Composition (C1) | |
|---|---|
| Lubricant Characteristics | |
| Ratio of Primary to Secondary Alcohol | 0.33:1 |
| Zinc from Antiwear System | 696 ppm |
| Phosphorus from Antiwear System | 634 ppm |
| Boron | 59 ppm |
| Molybdenum | 50 ppm |
| Calcium from detergent system | 1392 ppm |
| Magnesium from detergent system | 371 ppm |
| Total metals from detergent system | 1763 ppm |
| Phosphorus/Detergent Metal | 0.36 |
| Lubricant TBN | 5.4 |
| Phosphorus/Lubricant TBN | 117.4 |
| Calculated SASH | 0.8 |
| Total High Temperature Deposit (TEOST-33C) | 20.3 |

In the detergent system of Table 2, the calcium sulfonate had a TBN of about 300 and about 11.9 weight percent calcium, and the magnesium sulfonate had a TBN of about 400 and about 9.6 weight percent magnesium. In the antiwear system, ZDDP A was a zinc dialkyldithiophosphate and included alkyl groups derived from methyl isobutyl carbinol and included about 7 weight percent phosphorus, about 14.8 weight percent sulfur, and about 7.8 weight percent zinc. ZDDP B was also a zinc dialkyldithiophosphate but included alkyl groups derived from ethyl hexyl alcohol and included about 6 weight percent phosphorus, about 13 weight percent sulfur, and about 6.8 weight percent zinc. While this comparative lubricating composition exhibited passing high temperature deposits below about 30 mg (TOEST-33C), it had a relatively high calculated SASH of 0.8 weight percent.

The calculated sulfated ash (SASH) for Table 2 above was determined as follows: Comparative Example 1 (CE-1) included of 59 ppmw of boron, 1392 ppmw of calcium, 371 ppmw of magnesium, 50 ppmw of molybdenum, and 696 ppmw of zinc. To determine the amount of SASH present in CE-1 the following calculations were carried out:

59 ppmw of boron×3.22=189.98

1392 ppmw of calcium×3.4=4732.8

371 ppmw of magnesium×4.95=1836.5

50 ppmw of boron×1.5=75

696 ppmw of zinc×1.5=1044

(189.98+4732.8+1836.5+75+1044)/10000=0.79 weight percent SASH

All sulfated ash (SASH) values given in the present application were determined using this calculation method.

Comparative Example 2

In order to reduce the amount of ash, comparative lubricating compositions were prepared using lower levels of detergent additives to provide lower levels of total metals. Table 3 below shows the detergent and antiwear systems included in these further Comparative Lubricating Compositions, which were formulated into finished lubricants including the same amount of and the same dispersant(s), antioxidant(s), organo-molybdenum additive(s), antifoam additive(s), friction modifies(s), olefin copolymer viscosity modifier(s), pour point dispersant(s), process oil(s) and base oil(s) of the comparative lubricating composition from Table 2 in Example 1. The detergents and antiwear additives were the same as those described in Example 1.

TABLE 4

| | I-1 | I-2 | I-3 |
|---|---|---|---|
| Detergent System | | | |
| Calcium sulfonate (300 TBN) | 1.0% | 1.0% | 01.0% |
| Magnesium Sulfonate (400 TBN) | 0.4% | 0.4% | 0.4% |
| Antiwear System | | | |
| ZDDP A (100% MIBC) | 0.49% | 0.28% | 0.07% |
| ZDDP B (100% ethyl hexyl alcohol) | 0.16% | 0.092% | 0.023% |
| Lubricant Characteristics | | | |
| Ratio of Primary to Secondary Alcohol | 0.33:1 | 0.33:1 | 0.33:1 |
| Zinc from Antiwear System | 492 ppm | 274 ppm | 72 ppm |
| Phosphorus from Antiwear System | 449 ppm | 251 ppm | 65 ppm |
| Boron | 65 ppm | 65 ppm | 54 ppm |
| Molybdenum | 51 ppm | 50 ppm | 50 ppm |
| Calcium from detergent system | 1284 ppm | 1248 ppm | 1270 ppm |
| Magnesium from detergent system | 367 ppm | 370 ppm | 382 ppm |
| Total metals from detergent system | 1651 ppm | 1613 ppm | 1652 ppm |
| Phosphorus/Detergent Metal | 0.27 | 0.16 | 0.04 |
| Lubricant TBN | 5 | 5.2 | 5 |
| Phosphorus/Lubricant TBN | 89.8 | 48.2 | 13 |
| Calculated SASH | 0.72% | 0.68% | 0.66% |
| Total High Temperature Deposit (TEOST-33C) | 19.2 mg | 21.5 mg | 14.7 mg |

As shown above in Table 3, while the calculated amount of sulfated ash was lower in comparative samples C2 to C4 when the level of detergent was dropped, the total high temperature deposits increased to unacceptable levels about 30 mg. These comparative samples had a ratio of phosphorus to lubricant TBN of 172 to 635 and a ratio of phosphorus to total detergent metals of 0.55 to 3.87.

Example 1

Inventive lubricating compositions were prepared with lower levels of ash and lower high temperature deposits by selecting the unique relationships of phosphorus, metals, and TBN as described herein. Table 4 below shows the detergent and antiwear systems included in these Inventive Lubricating Composition, which were formulated into finished lubricants including the same amount of and the same dispersant (s), antioxidant(s), organo-molybdenum additive(s), antifoam additive(s), friction modifier(s), olefin copolymer viscosity modifier(s), pour point dispersant(s), process oil(s) and base oil(s) of the comparative lubricating composition from Table 2 in Example 1. The detergents and antiwear additives were the same as those described in Example 1.

TABLE 5

| | I-4 | I-5 | I-6 |
|---|---|---|---|
| Detergent System | | | |
| Calcium sulfonate (300 TBN) | 0.7% | 0.4% | 0.1% |
| Magnesium Sulfonate (400 TBN) | 0.28% | 0.16% | 0.04% |
| Antiwear System | | | |
| ZDDP A (100% MIBC) | 0.49% | 0.28% | 0.07% |
| ZDDP B (100% ethyl hexyl alcohol) | 0.16% | 0.092% | 0.023% |

TABLE 5-continued

| | I-4 | I-5 | I-6 |
|---|---|---|---|
| Lubricant Characteristics | | | |
| Ratio of Primary to Secondary Alcohol | 0.33:1 | 0.33:1 | 0.33:1 |
| Zinc from Antiwear System | 485 ppm | 299 ppm | 69 ppm |
| Phosphorus from Antiwear System | 445 ppm | 371 ppm | 63 ppm |
| Boron | 65 ppm | 69 ppm | 75 ppm |
| Molybdenum | 50 ppm | 51 ppm | 51 ppm |
| Calcium from detergent system | 902 ppm | 641 ppm | 133 ppm |
| Magnesium from detergent system | 264 ppm | 149 ppm | 37 ppm |
| Total metals from detergent system | 1166 ppm | 790 ppm | 170 ppm |
| Phosphorus/Detergent Metal | 0.38 | 0.34 | 0.37 |
| Lubricant TBN | 3.7 | 2.7 | 1 |
| Phosphorus/Lubricant TBN | 120.3 | 100.3 | 63 |
| Calculated SASH | 0.54% | 0.37% | 0.11% |
| Total High Temperature Deposit (TEOST-33C) | 20.4 mg | 16.4 mg | 10.0 mg |

Inventive Samples I-1 to I-3 demonstrated lower levels of ash calculated as sulfated ash and acceptable levels of high temperature deposits. These inventive samples had a ratio of phosphorus to lubricant TBN of about 13 to about 89 and a ratio of phosphorus to total detergent metals of about 0.04 to about 0.3.

Example 2

Further Inventive lubricating compositions were prepared with lower levels of ash by decreasing the amount of both the detergent system and the antiwear components with the noted relationships of phosphorus, metals, and TBN. Table 5 below shows the detergent and antiwear systems included in these Inventive Lubricating Composition, which were formulated into finished lubricants including the same amount of and the same dispersant(s), antioxidant(s), organo-molybdenum additive(s), antifoam additive(s), friction modifies(s), olefin copolymer viscosity modifier(s), pour point dispersant(s), process oil(s) and base oil(s) of the comparative lubricating composition from Table 2 in Example 1. The detergents and antiwear additives were the same as those described in Example 1.

TABLE 3

| Inventive Lubricating Compositions | | | |
|---|---|---|---|
| | C2 | C3 | C4 |
| Detergent System | | | |
| Calcium sulfonate (300 TBN) | 0.7% | 0.4% | 0.1% |
| Magnesium Sulfonate (400 TBN) | 0.28% | 0.16% | 0.04% |
| Antiwear System | | | |
| ZDDP A (100% MIBC) | 0.7% | 0.7% | 0.7% |
| ZDDP B (100% ethyl hexyl alcohol) | 0.23% | 0.23% | 0.23% |
| Lubricant Characteristics | | | |
| Ratio of Primary to Secondary Alcohol | 0.33:1 | 0.33:1 | 0.33:1 |
| Zinc from Antiwear System | 709 ppm | 699 ppm | 687 ppm |
| Phosphorus from Antiwear System | 640 ppm | 641 ppm | 635 ppm |
| Boron | 63 ppm | 58 ppm | 56 ppm |
| Molybdenum | 51 ppm | 50 ppm | 49 ppm |
| Calcium from detergent system | 903 ppm | 504 ppm | 128 ppm |
| Magnesium from detergent system | 260 ppm | 151 ppm | 36 ppm |
| Total metals from detergent system | 1163 ppm | 655 ppm | 164 ppm |
| Phosphorus/Detergent Metal | 0.55 | 0.98 | 3.87 |
| Lubricant TBN | 3.7 | 2.2 | 1.0 |

TABLE 3-continued

| Inventive Lubricating Compositions | | | |
|---|---|---|---|
| | C2 | C3 | C4 |
| Phosphorus/Lubricant TBN | 172.9 | 291.4 | 635 |
| Calculated SASH | 0.57% | 0.19% | 0.14% |
| Total High Temperature Deposit (TEOST-33C) | 35.9 mg | 49.0 mg | 53.8 mg |

Inventive Samples I-4 to I-6 demonstrated lower levels of ash calculated as sulfated ash and acceptable levels of high temperature deposits. These inventive samples had a ratio of phosphorus to lubricant TBN of about 63 to about 120 and a ratio of phosphorus to total detergent metals of about 0.34 to about 0.38.

Figure 2:
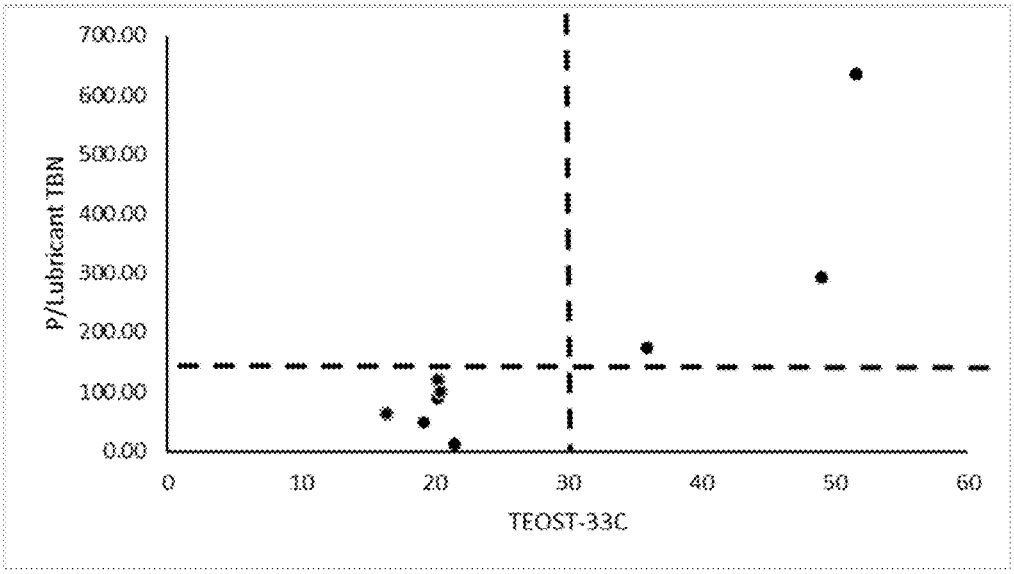
FIG. 2 is a plot of phosphorus amount to detergent TBN relative to the amount of high temperature deposits.
Figure 3:
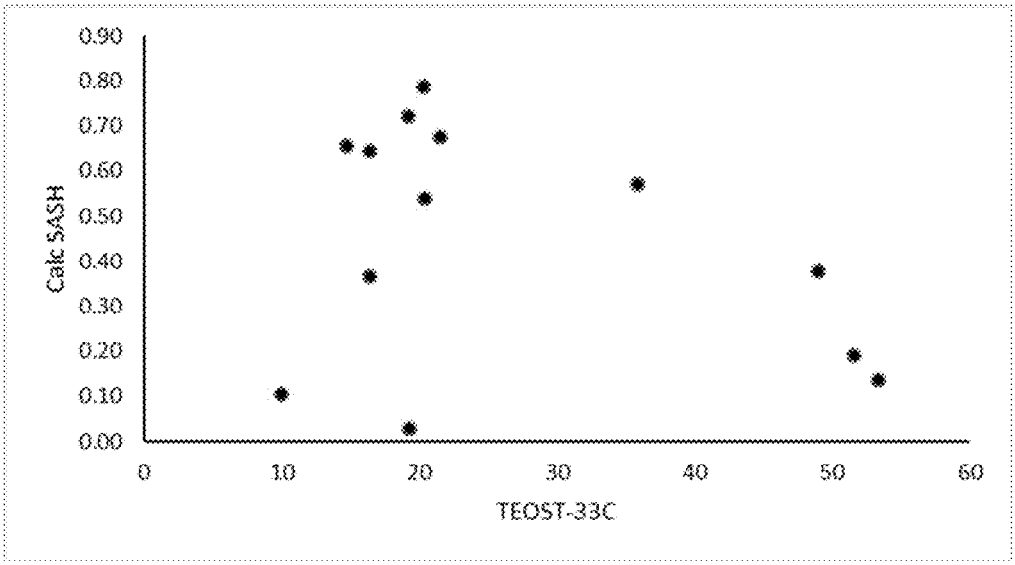
FIG. 3 is a plot of calculated SASH relative to the amount of high temperature deposits.

The graph of FIG. 2 shows the ratio of phosphorus to lubricant TBN relative to the high temperature deposits of the inventive and comparative samples in Comparative Example 2 and Inventive Examples 1 and 2. The graph of FIG. 1 shows the ratio of phosphorus to total detergent metals relative to the high temperature deposits of the inventive and comparative samples in Comparative Example 2 and Inventive Examples 1 and 2. Lastly, the graph of FIG. 3 shows that calculated levels of sulfated ash by itself has no impact on high temperature deposits, but only through the select ratios shows in FIGS. 1 and 2 does low ash formations achieve passing high temperature deposits It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A lubricating composition for reducing high temperature deposits, the lubricating composition comprising:

one or more base oils of lubricating viscosity;

a detergent system providing an amount of metal to the lubricating composition, where the metal is at least one of sodium, calcium, magnesium, or combinations thereof, wherein the detergent system includes about 55 to about 75 weight percent of a detergent additive providing calcium and about 25 to about 45 weight percent of a detergent additive providing magnesium;

an antiwear system including one or more metal dialkyl dithiophosphates derived from one of primary alcohols, secondary alcohols, or combinations thereof and providing an amount of phosphorus to the lubricating composition;

wherein a total base number (TBN) of the lubricating composition is from about 0.5 to about 20;

wherein a ratio of phosphorus from the antiwear system relative to the TBN of the lubricating composition is about 150 or less;

wherein the lubricating composition includes a total amount of metals such that the composition has no more than about 0.8 weight percent of calculated sulfated ash; and wherein the lubricating composition has less than about 30 mg of deposits when subjected to the high temperature deposit formation test of ASTM D6335.

2. The lubricating composition of claim 1, wherein the ratio of phosphorus from the antiwear system relative to the TBN is about 120 or less.

3. The lubricating composition of claim 2, wherein the lubricating composition includes no more than about 800 ppm of phosphorus from the antiwear system.

4. The lubricating composition of claim 3, wherein the lubricating composition includes no more than about 1800 ppm of metal from the detergent system.

5. The lubricating composition of claim 1, wherein a ratio of phosphorus from the antiwear system relative to the amount of metal from the detergent system is about 0.5 or less.

6. The lubricating composition of claim 1, wherein the detergent system provides about 10 to about 1500 ppm of calcium and about 10 to about 500 ppm magnesium.

7. The lubricating composition of claim 1, wherein the antiwear system includes two metal dialkyl dithiophosphates.

8. The lubricating composition of claim 1, wherein the antiwear system includes two zinc dialkyl thiophosphates and wherein a first zinc dialkyl dithiophosphate is derived from primary alcohols and a second zinc dialkyl dithiophosphate is derived from secondary alcohols.

9. The lubricating composition of claim 8, wherein the antiwear system includes a majority of the second zinc dialkyl dithiophosphate derived from secondary alcohols.

10. The lubricating composition of claim 9 wherein the antiwear system includes about 20 to about 30 weight percent of the first zinc dialkyl dithiophosphate derived from primary alcohols and about 70 to about 80 weight percent of the second zinc dialkyl dithiophosphate derived from secondary alcohols.

11. The lubricating composition of claim 1, wherein the detergent system includes a calcium sulfonate, calcium phenate, or combination thereof having a total base number of 200 to 500.

12. The lubricating composition of claim 11, wherein detergent system includes a magnesium sulfonate, magnesium phenate, or combination thereof having a total base number of 200 to about 500.

13. The lubricating composition of claim 1, wherein the total base number of the lubricating composition is less than about 10.

14. The lubricating composition of claim 1, further comprising an amount of zinc provided by the antiwear system and wherein an amount of zinc from the antiwear system relative to the amount of total metals from the detergent system is about 0.6 or less.

15. The lubricating composition of claim 14, wherein the antiwear system provides about 50 to about 850 ppm of zinc to the lubricating composition.

16. The lubricating composition of claim 1, wherein the lubricating composition is a passenger car motor oil.

17. A low ash lubricating composition for reducing high temperature deposits, the lubricating composition comprising:

one or more base oils of lubricating viscosity;

a detergent system providing an amount of metal to the lubricant composition, where the metal is at least one of sodium, calcium, magnesium, or combinations thereof, wherein the detergent system includes about 55 to about 75 weight percent of a detergent additive providing calcium and about 25 to about 45 weight percent of a detergent additive providing magnesium;

an antiwear system including one or more metal dialkyl dithiophosphates derived from one of primary alcohols, secondary alcohols, or combinations thereof and providing an amount of phosphorus to the lubricating composition;

wherein a ratio of phosphorus from the antiwear system relative to the amount of metal from the detergent system is about 0.5 or less;

wherein the lubricating composition includes a total amount of metals such that the composition has no more than about 0.8 weight percent of calculated sulfated ash; and wherein the lubricating composition has less than about 30 mg of deposits when subjected to the high temperature deposit formation test of ASTM D6335.

18. The low ash lubricating composition of claim 17, wherein the lubricating composition includes no more than about 800 ppm of phosphorus from the antiwear system and no more than about 1800 ppm of metal from the detergent system.

19. A method of lubricating an engine with a lubricating composition that meets API SP/ILSAC GF-6 standards, the method comprising lubricating the engine with a lubricating composition, the lubricating composition including one or more base oils of lubricating viscosity; a detergent system providing an amount of metal to the lubricant composition, where the metal is at least one of sodium, calcium, magnesium, or combinations thereof, wherein the detergent system includes about 55 to about 75 weight percent of a detergent additive providing calcium and about 25 to about 45 weight percent of a detergent additive providing magnesium; an antiwear system including one or more metal dialkyl dithiophosphates derived from one of primary alcohol, secondary alcohol, or combinations thereof and providing an amount of phosphorus to the lubricating composition; wherein a total base number (TBN) of the lubricating composition is from about 0.5 to about 20; and wherein a ratio of phosphorus from the antiwear system relative to the TBN of the lubricating composition is about 150 or less; and wherein the lubricating composition has a total amount of metals such that the lubricating composition has no more than about 0.8 weight percent of calculated sulfated ash and wherein the lubricating composition has less than about 30 mg of deposits when subjected to the high temperature deposit formation test of ASTM D6335.

20. The method of claim 19, wherein the lubricating composition includes no more than about 800 ppm of phosphorus from the antiwear system.

21. The method of claim 19, wherein the lubricating composition includes no more than about 1800 ppm of total metals from the detergent system.

22. The method of claim 19, wherein the detergent system provides about 10 to about 1500 ppm of calcium and about 10 to about 500 ppm magnesium.

23. The method of claim 19, wherein the total base number of the lubricating composition is less than about 10.

24. The method of claim 19, wherein the antiwear system provides about 50 to about 850 ppm zinc to the lubricating composition and wherein an amount of zinc from the antiwear system relative to the amount of total metals from the detergent system is about 0.6 or less.

* * * * *